United States Patent [19]

Eickhof

[11] Patent Number: 4,644,711

[45] Date of Patent: Feb. 24, 1987

[54] FASTENING APPARATUS FOR SHUTTERS

[75] Inventor: John K. Eickhof, Crookston, Minn.

[73] Assignee: Paul Eickhof, Crookston, Minn. ; a part interest

[21] Appl. No.: 682,655

[22] Filed: Dec. 17, 1984

Related U.S. Application Data

[63] Continuation-in-part of Ser. No. 437,907, Nov. 1, 1982, abandoned.

[51] Int. Cl.[4] ..... E04B 2/82

[52] U.S. Cl. ..... 52/127.11; 52/126.7; 52/136; 52/235; 52/511

[58] Field of Search ..... 52/126.7, 127.11, 127.12, 52/136–140, 235, 236.9, 365, 378, 379, 489, 52/509–511, 698, 704, 706; 248/244, 295.1, 656

[56] References Cited

U.S. PATENT DOCUMENTS

| | | | |
|---|---|---|---|
| 1,300,173 | 4/1919 | Kennedy | 52/136 |
| 1,691,568 | 11/1928 | Gorman | 52/136 |
| 1,937,647 | 12/1933 | Geesey et al. | 52/137 |
| 2,443,548 | 6/1948 | Wilson . | |
| 2,679,993 | 6/1954 | Christophersen | 248/231 |
| 2,805,739 | 9/1957 | Dennison | 52/127.12 |
| 2,814,942 | 12/1957 | Sinner | 52/136 |
| 3,319,983 | 5/1967 | Zibell | 403/400 |
| 3,323,265 | 6/1967 | Petersen | 52/302 |
| 3,342,005 | 9/1967 | Rickards et al. | 52/702 |
| 3,350,830 | 11/1967 | Smith, Jr. et al. | 52/509 |
| 3,465,996 | 9/1969 | Von Wedel | 52/235 |
| 3,541,746 | 11/1970 | Scott | 52/127.12 |
| 3,550,337 | 12/1970 | Lorenz | 52/136 |
| 3,621,635 | 11/1971 | De Lange | 52/235 |
| 3,778,942 | 12/1973 | Bondi | 52/509 |
| 3,834,099 | 9/1974 | Haeussler | 52/235 |
| 3,888,055 | 6/1975 | Gallo | 52/98 |
| 3,897,663 | 8/1975 | Gaul | 52/283 |
| 3,905,169 | 9/1975 | Gallo | 52/509 |
| 3,981,117 | 9/1976 | Dehlen | 52/509 |
| 3,990,199 | 11/1976 | Gallo | 52/235 |
| 4,064,664 | 12/1977 | Gaul | 52/235 |
| 4,292,779 | 10/1981 | Landheer | 52/489 |

FOREIGN PATENT DOCUMENTS

| | | | |
|---|---|---|---|
| 539308 | 7/1955 | Belgium | 52/484 |
| 468477 | 10/1950 | Canada | 52/509 |
| 1683214 | 8/1970 | Fed. Rep. of Germany | 52/235 |
| 1271363 | 6/1968 | Fed. Rep. of Germany | 52/235 |
| 2006641 | 8/1971 | Fed. Rep. of Germany | 52/235 |
| 2009682 | 9/1971 | Fed. Rep. of Germany | 52/235 |
| 6617920 | 2/1967 | Netherlands | 52/236.9 |
| 896576 | 2/1961 | United Kingdom | 52/489 |
| 1297003 | 11/1972 | United Kingdom | 52/235 |

*Primary Examiner*—John E. Murtagh
*Assistant Examiner*—Andrew Joseph Rudy
*Attorney, Agent, or Firm*—Merchant, Gould, Smith, Edell, Welter & Schmidt

[57] ABSTRACT

Fastening apparatus for shutters and a method of attachment thereof is disclosed. The fastening apparatus is hidden, yet operable, from in front of the face of the shutters. A plurality of studs are held by nuts retained within a cavity of a holding member attached to the framework, such as a columbarium or mausoleum structure. Rotation of the nuts on the stud moves the stud against ramp members fastened to the rearside of the shutters thereby drawing the shutters to the framework.

11 Claims, 8 Drawing Figures

FIG. 2
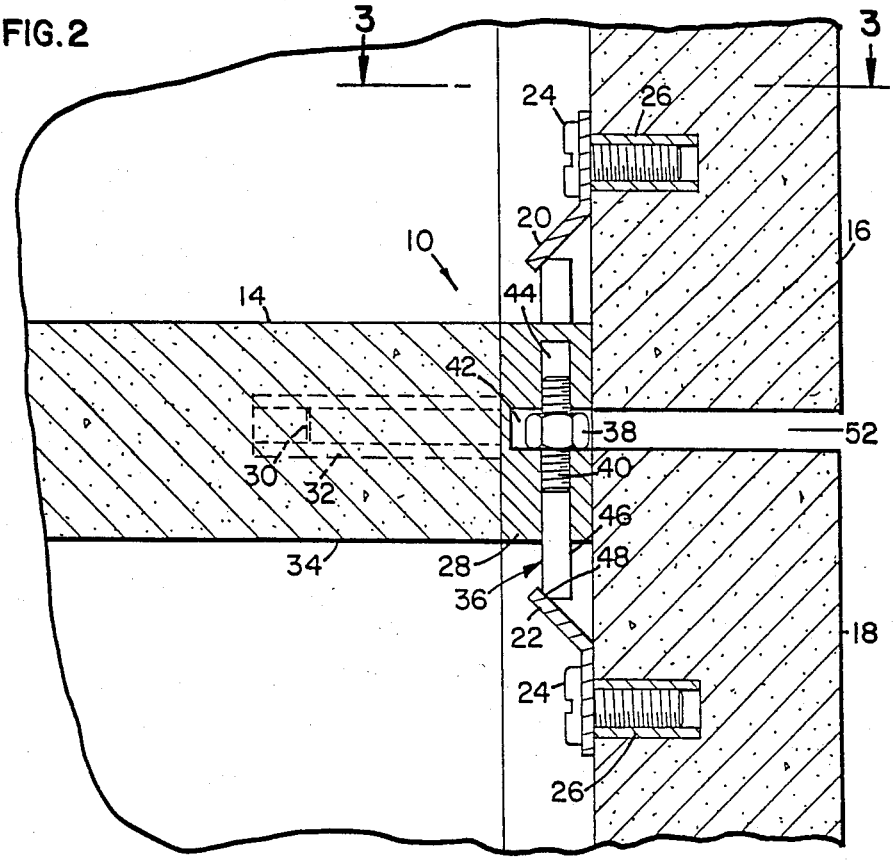
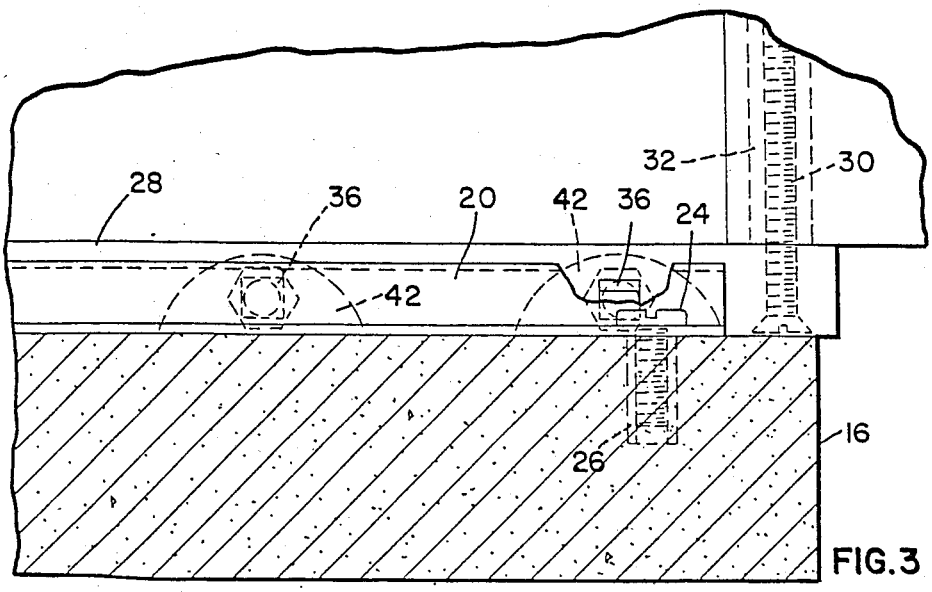
FIG. 3

FASTENING APPARATUS FOR SHUTTERS

This is a continuation-in-part of Ser. No. 437,907, filed Nov. 1, 1982, now abandoned.

FIELD OF THE INVENTION

The invention relates to fastening mechanism for attaching stone slabs, wood panels or other such shutters to a framework or structure for the purpose of presenting a substantially planar wall. Such slabs are commonly used to cover niches and crypts for columbariums and mausoleums, but may also be used to attach any type of shutter to a physical structure.

BACKGROUND OF THE INVENTION

There are several applications wherein a stone facing is desired, which facing at the same time allows removal of at least portions of the facing to obtain access to something behind the facing. Common applications include columbariums and mausoleums. A stone facing in a columbarium or mausoleum, for example, presents a very rich appearance, and, to provide a proper solemn and reverent atmosphere, it is appropriate to minimize decorations, brackets or various other protuberances on the facing. Usually, each niche or crypt in such a structure has a single stone shutter which combines with adjacent shutters to form a wall.

Mounting or hanging devices for holding facing slabs or shutters to columbarium or mausoleum structures are known. Perhaps the most commonly used type are those shown generally in U.S. Pat. No. 3,778,942, U.S. Pat. No. 3,905,169 and U.S. Pat. No. 3,990,199. Typically, a bracket is fastened to the wall structure, and a decorative rosette is attached to a threaded stud screws into the brackets. The decorative rosette is located on the front of the shutters to clamp the shutters to the bracket or framework therebehind. Thus, a regular pattern of rosettes is formed on the wall.

Another type of art is exemplified by U.S. Pat. No. 4,064,664 wherein a cover slab is hung from a support member.

Although these devices in the art accomplish the function of locating a flat slab against a frame structure, annoying problems are apparent. For example, with the former devices the rosettes are always readily visible and thus somewhat gaudy. With the latter devices, facing slabs may be removed too easily by vandals or other unauthorized individuals.

SUMMARY OF THE INVENTION

The present invention is directed to apparatus for fastening a shutter to a structure. The shutter has a front and a back with the back facing the structure. The shutter also has opposite top and bottom ends. The fastening apparatus includes a plurality of brackets attached to the structure and mechanism for resting the shutter on a pair of the brackets. The resting mechanism is attached to the shutter near the bottom of the shutter. The fastening mechanism includes a cam member and mechanism for movably holding the cam member. The holding mechanism is attached to the structure. A receiving mechanism for being cammed by the cam member is attached near the top of the shutter. In this way, the bottom of the shutter is held to the structure by the resting mechanism attached to the shutter resting on at least a pair of the brackets attached to the structure, while the top of the shutter is held by a cam member moved into the receiving mechanism thereby drawing the top of the shutter to the structure and firmly holding it.

In a preferred embodiment, upper and lower ramp members are attached to the backside near the upper and lower edges of the first shutter. The upper ramp member has an inclined surface facing generally upwardly and outwardly while the lower ramp member has an inclined surface facing generally downwardly and outwardly. A first holding member is attached to an appropriate frame structure or to an outer edge of an upper or top wall of a niche or crypt which is to be covered by the first shutter. A second holding member is attached to the frame structure or to an outer edge of the lower or bottom wall of the same niche or crypt. Each of the holding members includes a plurality of studs, usually three. Each of the studs has a noncircular cross-sectional portion and a generally circular cross-sectional portion, the circular portions being threaded. Each of the holding members includes vertically extending openings equal in number to the number of studs to be held by each holding member. Each opening has an inner circular portion slightly larger than the circular portion of the stud, and an outer noncircular portion slightly larger than the noncircular portion of the stud. Alternate openings open upwardly and downwardly. The inner and outer portions of the openings are separated by a cavity which opens forwardly in each holding member. Each stud is retained in its opening by a nut threaded about the threaded circular portion of the stud, and each nut is retained in the corresponding cavity.

It is usually desirable to fasten a large number of adjacent shutters to a columbarium or mausoleum structure to form a substantially planar wall. It is preferable, therefore, to include three studs with each holding member such that two of the studs are vertically movable to hold a shutter above them while the third is located between the other two and holds the top of a shutter below the holding member. Shutters are sized so that a small separation exists between adjacent shutters. In this fashion, a wrench may be inserted through the separation to turn the nut and move a stud against a ramp member. With two lower studs moving against the lower ramp member and one upper stud moving against the upper ramp member, a three-point adjustable fastening mechanism draws the shutter toward the framework to securely hold it.

With respect to the prior art, the present invention is particularly advantageous since it allows the presentation of a plane shuttered wall without such devices as rosettes providing unwanted ornamentation. Additionally, each shutter is securely held and not easily displaced by unauthorized persons.

Another advantage inherent with the structure of the present invention is that a single holding device functions to hold a portion of both the upper and lower shutters. A slight separation between the adjacent shutters provides for the insertion of a wrench to accomplish appropriate loosening or tightening.

The three-point cam action is advantageous in that it allows for angular and planar adjustability.

In an alternate embodiment, a pair of clips are attached in a spaced-apart fashion near the bottom of a shutter. The clips include an inverted cradle portion. A pair of hanger brackets each having a horizontal member extending therefrom are attached to the frame structure or to opposite walls of a crypt or niche of a mausoleum or columbarium. The cradle portions of the clips are fitted over the horizontal members of the hanger brackets to hold the bottom portions of the shutters with respect to the structure. Near the top middle of the shutter, a third clip having an inverted cradle portion is attached. A stud and holding mechanism as briefly described hereinabove is fastened to the frame structure so that the stud may be moved so that its end may cam against the inclined wall of the cradle portion of the third clip thereby camming the upper portion of the shutter to the structure and holding it firmly thereto.

A particularly advantageous feature of the alternate embodiment is that the more complex camming studs and holding mechanisms near the bottom portion of the shutter may be replaced by more simple hanger brackets and clips. In addition, the clips are formed to have upwardly inclined walls for insertion into slots in the rock shutters. Such slots may be made by a simple saw cut and with the inclined walls received within the slots, the clips may be held firmly with a small amount of adhesive. Thus, a shutter may be attached to the frame structure simply by placing the cradle portions of the clips near the bottom edge of the shutter onto the hanger brackets and pivoting the shutter about the cradle portions so that the shutter is against the frame structure. The nut on the stud is then turned by inserting a wrench through the separation between the shutter to be attached and the next adjacent shutter and turning the nut so as to move the stud and, therefore, the cam at the end of the stud against the inclined surface of the clip at the top of the shutter thereby camming and drawing the top of the shutter to the frame structure and holding it solidly thereto.

These advantages and other objects obtained by the use of this invention are further explained and may be better understood by reference to the drawings which form a further part of this disclosure and to the descriptive matter hereinafter in which there is described in more detail preferred and alternate embodiments of the invention.

BRIEF DESCRIPTION OF THE DRAWINGS

FIG. 2 is a cross-sectional view taken along line 2—2 of FIG. 1;

FIG. 3 is a cross-sectional view taken along line 3—3 of FIG. 2;

DETAILED DESCRIPTION OF THE PREFERRED EMBODIMENT

Figure 1:
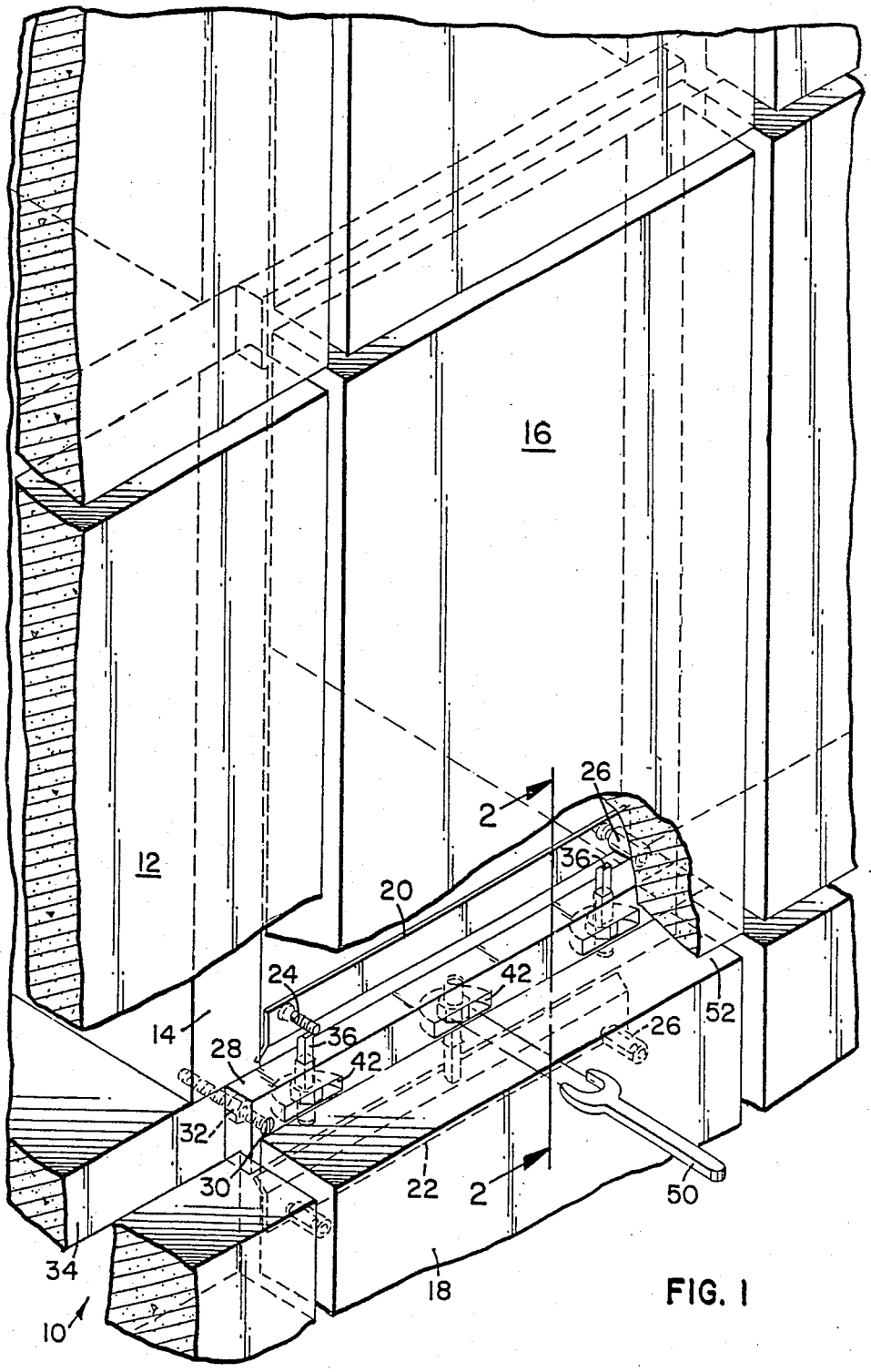
FIG. 1 is a partially cut away perspective view of fastening apparatus in accordance with the present invention, showing some elements of the invention in phantom lines.
Figure 4:
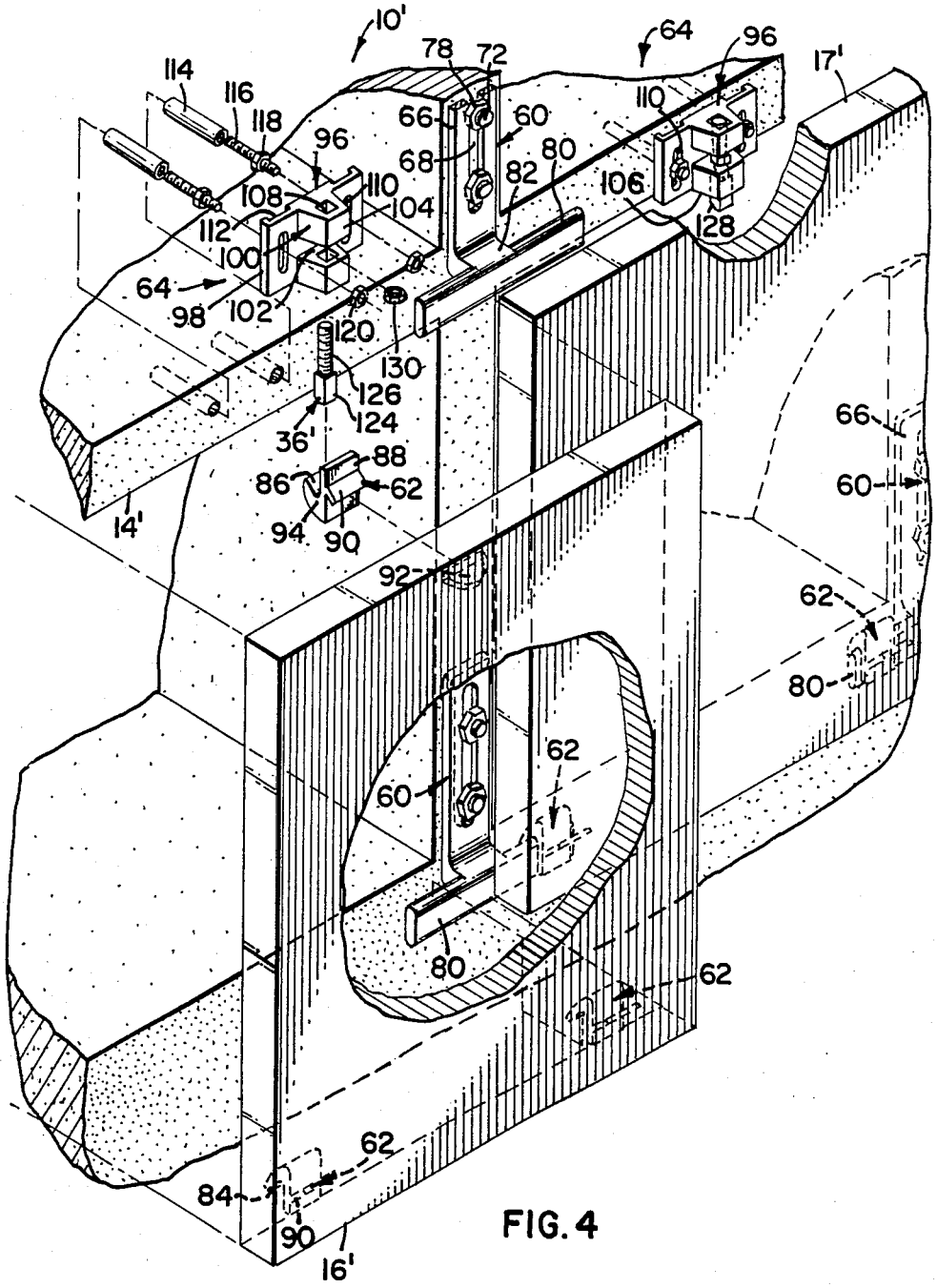
FIG. 4 is a partially cut away perspective view of an alternate embodiment, showing some elements of the embodiment in phantom lines.
Figure 5:
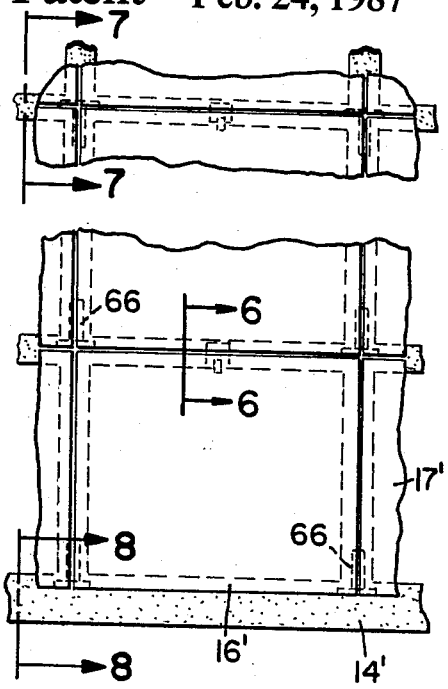
FIG. 5 is a front elevational view of a wall with shutters attached using the alternate embodiment.

Referring now to the drawings wherein like reference numerals designate identical or corresponding parts throughout the several views, and more particularly to FIG. 1, preferred fastening apparatus in accordance with the present invention is designated generally as 10. Apparatus 10 holds slabs 12, commonly of a rock material such as marble or granite and referred to as shutters, to a structure 14. Fastening apparatus 10 typically holds the lower end of an upper shutter 16 and the upper end of a lower shutter 18. Structure 14 is described hereinafter with respect to the structure of a mausoleum or columbarium. It is understood, however, that the fastening apparatus 10 of the present invention may be used to hold shutters of various types on any type of frame structure which is designed to receive shutters as a covering.

A ramp member 20 is attached to a lower end of the backside of upper shutter 16, while a second ramp member 22 is attached to the upper end of the backside of lower shutter 18. Each of ramp members 20 and 22 are fastened typically by threading bolts 24 into inserts 26 frictionally held in appropriately sized openings in shutters 16 and 18. Ramp member 20 includes a portion for attachment to slab 16 as with screws 24 and also includes a ramp portion which extends downwardly with respect to shutter 16 and outwardly from the rearside of shutter 16. Thus, an inverted V-shaped slot is formed between member 20 and the rearside of shutter 16. Ramp member 22 is similarly shaped except its ramp portion extends upperwardly and outwardly to form a V-shaped slot.

A holding member 28 is attached with a plurality of screws 30 to inserts 32 frictionally held in appropriate sized openings in the bottom wall 34 of the crypt or niche compartment covered by shutter 16. Wall 34 also forms the top wall of the compartment covered by shutter 18. That is, for a crypt or niche of a mausoleum or columbarium structure, a columbarium commonly has a back wall and four walls extending forwardly from the edges of the back wall. At least some of the walls are usually in common with walls of other adjacent compartments so wall 34 is in the bottom of a first compartment and a top of an adjacent compartment. For a structure other than a columbarium or mausoleum the element represented by wall 34 is ordinarily the bottom of a first space and the top of an adjacent space. Holding member 28 provides an appropriate supporting member for studs or cam members which apply straight line forces against ramp members 20 and 22 to cam and draw shutters 16 and 18 tightly to structure 14. Holding member 28 has a rectangular shape with thickness greater than the width of a nut 38 sized to threadingly receive the threaded portion 40 of stud 36. Holding member 28 includes three semi-cylindrical cavities evenly spaced lengthwise and centered widthwise. Cavities 42 open toward shutters 16 and 18. Cavities 42 have sufficient length to allow nuts 38 to easily fit therein.

Holding member 28 further includes vertically aligned passages 44. Each passage 44 has a centerline which passes through one of cavities 42. Each passage 44 is approximately centered in the lengthwise direction on its particular cavity 42 and is somewhat forward of the center of holding member 28. Each cavity 42 and passage 44 are arranged relative to one another so that a nut 38 when received about a stud 36 can be turned without contacting the wall of cavity 42 or extending beyond the front plane of holding member 28.

Each stud 36 has a round threaded portion 40 and a noncircular portion 46 which extends outwardly from holding member 28. Correspondingly, each passage 44 has an innermost, circular portion and outermost, noncircular portion (see FIG. 1). The circular and noncircular portion of passages 44 are somewhat larger than the round threaded portion 40 and the noncircular portion 46 of the studs 36, respectively, to allow easy movement of studs 36 within passages 44. In this fashion, a nut 38 retained within a cavity 42 and threaded onto a stud 36 likewise retains a stud 36 to holding member 28. As a particular nut 38 is turned, the interference between the noncircular portion of cavity 42 and stud 36 prevents stud 36 from rotating and, therefore, allows stud 36 to translate vertically upwardly or downwardly. The outer end of stud 36 includes a slanted portion or cam surface 48 for conforming with the angle of either ramp member 20 or 22.

To use, ramp members such as 20 and 22 are installed on all shutters 12. Thus, each shutter has a ramp member 22 near its rear uppermost edge and a ramp member 20 near its lowermost edge. A holding member 28 is installed at a central location along the front end of each horizontal member forming a wall for a crypt or niche or compartment in the mausoleum or columbarium or other structure. It is understood, of course, that there could be separate ramp members and holding members for each stud 36. Studs 36 are threaded onto nuts 38. A first shutter, such as 16, for covering a first compartment or other space, is placed such that the two outer studs 36 held by a particular lower or second holding member 28 extend into the inverted V-shaped slot formed by ramp member 20 and the rear surface of first shutter 16. The center stud of an upper or first holding apparatus 10 along the upper end of first shutter 16 is then moved downwardly by inserting a thin wrench 50 through the separation 52 between first shutter 16 and a shutter to turn the appropriate nut 38. The two lower second studs and the one upper stud are appropriately tightened thereby drawing or camming shutter 16 inwardly and holding it tightly against the structure 14. The three-point contact of studs 46 against ramp members 20 and 22 provide for adjustment upperwardly, sidewardly, or angularly. Thus, a plurality of shutters may be fastened to a structure to provide a substantially planar face therein no bracketry extends to the face of each shutter, and each shutter is tightly held.

Any one shutter is easily removed simply by loosening the appropriate three studs by turning the appropriate nuts with a wrench 50.

An alternate embodiment of the present invention is shown in FIGS. 4–8. Elements in the alternate embodiment which are the same as those of the preferred embodiment are designated by the same numerals only the numerals are primed for the sake of clarity. The alternate apparatus 10' is comprised of hanger brackets 60 on which clips 62 rest to support the lower portions of a shutter like that designated as 16'. The upper portion of shutter 16' is held to structure 14' by a holding assembly 64.

Hanger bracket 60 has an inverted T shape. Vertical leg 66 includes a vertical slot 68 centered transversely on leg 66. A pair of spaced apart threaded studs 70 are installed in inserts 70 in structure 14' (see FIGS. 7 and 8). A nut 74 is part of threaded stud 70 and serves to space bracket 60 from structure 14' as desired. Vertical leg 66 may include a vertical recess portion 76 aligned with slot 68 for the purpose of receiving nuts 74. Threaded stud 70 protrudes through a slot 68 so that nut 78 may be threaded thereon to securely fasten bracket 60 to structure 14'. That is, leg 66 is held between nuts 74 and 78 with threaded stud 70 passing through slot 68. Bracket 60 may be adjusted upwardly or downwardly by loosening nuts 78 and sliding bracket 60 so that threaded rod 70 moves in slot 68.

Figure 7:
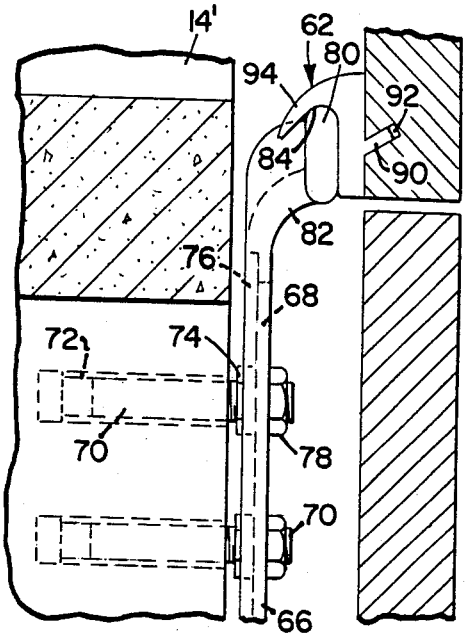
FIG. 7 is a cross-sectional view taken along line 7—7 of FIG. 5.

Hanger bracket 60 also includes a horizontal member 80. Generally, horizontal member 80 is located at the bottom of leg 66 so that bracket 60 forms an inverted T. As shown in FIG. 7, however, horizontal member 80 may also be located at the top of leg 66.

So that the standoff distance of shutter 16' from structure 14' is approximately uniform in the region of holding assembly 64 and hanger brackets 60, it is necessary that horizontal members 80 be spaced outwardly from structure 14'. Thus, there is a connecting neck 82 between leg 66 and horizontal member 80. Horizontal member 80 extends sufficiently far on either side of vertical leg 66 so that a clip 62 attached to each of adjacent shutters 16' and 17' may rest on a different end portion of horizontal member 80. Thus, a single hanger bracket 60 may support the lower right side of shutter 16' and the lower left side of shutter 17'.

Figure 6:
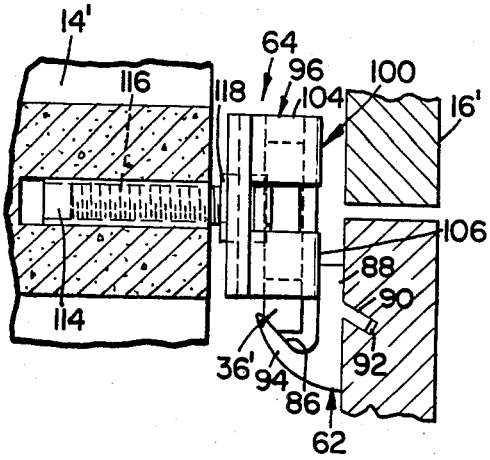
FIG. 6 is a cross-sectional view taken along line 6—6 of FIG. 5.
Figure 8:
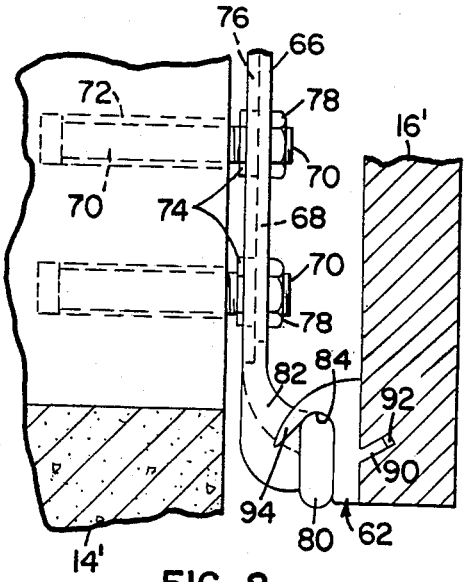
FIG. 8 is a cross-sectional view taken along line 8—8 of FIG. 5.

A pair of clips 62 are spaced apart and attached to the lower portion of shutter 16'. Clip 62 includes cradle portions 84 for fitting over and resting on horizontal member 80. At the same time, a clip 62 is turned around 180 degrees and installed near the top center of shutter 16' wherein a surface 86 of cradle portion 84 is cammed by stud 36' to hold the upper portion of shutter 16' as described more fully hereinafter. As shown in FIG. 6, a clip 62 has an upright wall 88. Wall 88 fits against the back of shutter 16'. An inclined wall 90 extends into a slot 92 in shutter 16'. On the side of upright wall 88 opposite inclined wall 90, another inclined wall 94 extends away from upright wall 88 so as to be substantially parallel with first inclined wall 90. When clips 62 are installed in a spaced-apart fashion near the lower end of shutter 16', inclined wall 92 which extends into shutter 16' is inclined upwardly. Inclined wall 94 extends away from the upper end of upright wall 88 and extends downwardly to form a cradle portion 84 for receiving horizontal member 80. When clip 62 is installed at the top center of shutter 16', inclined wall 92 which extends into shutter 16' is inclined downwardly, while inclined wall 94 is inclined upwardly from the lower end of upright wall 88. Clips 62 need not be long, but should be an inch or so in length so that they are sufficiently strong to provide the connecting function between shutter 16' and either hangers 60 or holding assembly 64.

Slots 92 for receiving inclined walls 90 of clips 62 are formed in shutter 16' simply by inclining a rotary saw at an appropriate angle and causing it to cut to a desired depth in shutter 16'. Thus, the slot is easy to form. Clips 62 are installed with adhesive between inclined walls 90 and slots 92 so they do not fall from shutter 16'. It has been found that the saw cut slots and installation of clip 62 do not result in a breakage or spalling of shutter 16' when shutter 16' is a rock slab. Use of inserts and bolts or threaded rods, on the other hand, frequently lead to spalling and a consequent structural weakness, as well as an appearance problem.

Holding assembly 64 includes holding member 96 and stud 36'. Holding member 96 may be machined, cast or otherwise assembled with a grouping of elements. Holding member 96 is formed to include a plate portion 98 having a front and back. A rectangularly enlarged portion 100 protrudes from the front of plate 98. Enlarged portion 100 is vertically oriented and is approximately centered between the side edges of plate 98. A cavity 102 divides enlarged portion 100 into upper and lower portions 104 and 106. Upper and lower portions 104 and 106 each have vertically aligned passages 108 which are noncircular, and preferably square. Vertically aligned slots 110 are formed in plate 98 on each side of enlarged portion 100. Plate 98 includes a recessed portion 112 in the back of plate 98 and vertically centered on each of slots 110.

Holding member 96 is held to structure 14' in a fashion similar to the fastening mechanism which holds hanger bracket 60 to structure 14'. A pair of anchors 114 are cast in structure 14'. Threaded studs 116 are threaded into anchors 114. A nut 118 is part of stud 116 and fits into recesses 112 of holding member 96 and serves as a standoff from structure 14' if desired. Holding member 96 is placed over protruding stud 116 such that studs 116 pass through slots 110. Nuts 120 are threaded onto studs 116 to fasten holding member 96 into place. Holding member 96 may be adjusted upwardly or downwardly along slots 110.

Stud 36' has a lower square portion 124 with a threaded rod portion 126 extending away therefrom. Square portion 124 includes an inclined surface 128 on the bottom end which inclines downwardly away from structure 14'. Stud 36' fits into aligned passages 108 such that square portion 128 is in passage 108 in lower enlargement 106. Nut 130 is threaded onto threaded portion 126 so as to be located between upper and lower enlargements 104 and 106 thereby holding stud 36' to holding member 96.

To use the alternate embodiment, appropriately spaced and sized holes are bored into structure 14' for the purpose of receiving anchors 72 and 114. Anchors 72 are aligned on a vertical separation between adjacent shutters near the bottom portion of the shutters, while anchors 114 are aligned on a horizontal separation between adjacent shutters and are centered transversely with respect to the shutters. Anchors 72 and 114 are installed and threaded studs 70 and 116 with nuts 74 and 118 are installed. Nuts 74 and 118 are positioned to provide an appropriate standoff for hanger brackets 60 and holding member 96 from structure 14'. Nuts 78 and 120 are then threaded onto the appropriate threaded rods to fasten hanger brackets 60 and holding member 96 in place. Each of hanger brackets 60 and holding member 96 may be adjusted vertically in the appropriate slots.

Clips 62 are installed on a shutter like 16' at a pair of spaced apart locations near the bottom of shutter 16' and at a centered location near the top of shutter 16'. The clips are installed at the back of the shutter. Upwardly inclined saw cuts are made for the bottom clips while a downwardly inclined saw cut is made for the upper clip. Each saw cut creates a slot 92 for receiving inclined wall 90 of each of the clips. A small amount of adhesive holds the clips in place. Clips 62 near the bottom of shutter 16' are installed so that inclined walls 94 form inverted cradle portions 84. Clip 62 near the top of shutter 16' is installed so that inclined wall 94 provides an upwardly inclined surface 86 against which inclined surface 128 on stud 36' may provide a camming force.

Shutter 16' is installed to form a wall for structure 14' by fitting the lower clip 62 over a pair of horizontal members 80 extending from opposite sides of shutter 16' toward one another. Each cradle portion 84 preferably mates with the hemispherical top and an elongated front surface of horizontal members 80. In this way, hanger brackets 60 and clips 62 fit solidly together. It is also noted that upright wall 88 has an elongated flat forward surface for mating with the back wall of shutter 16' to provide a solid connection therebetween.

With the lower clips 62 resting on hanger bracket 60, shutter 16' is pivoted about horizontal members 80 toward structure 14'. Stud 36' is then moved downwardly to engage the clip 62 installed in the upper portion of shutter 16'. That is, nut 130 is turned so that stud 36' moves downwardly. Surface 128 of stud 36' contacts surface 86 of clip 62. Nut 130 is turned until surface 128 cams shutter 16' as far toward structure 14' as possible to hold shutter 16' securely in place.

Shutter 16' is easily removed from structure 14' simply by loosening nut 130, pivoting shutter 16' about horizontal members 80 in a direction away from structure 14' and lifting shutter 16' from hanger members 60.

The present alternate embodiment is advantageous in that shutter installation and removal is accomplished by turning a single nut. As indicated hereinbefore, the present fastening apparatus is advantageous in that it is simple, yet firmly secures shutters to a structure and does so in a way which eliminates unsightly rosettes and other reminders of the fastening mechanism, and further does so in a way which makes it difficult for casual vandels to cause damage to a wall of shutters.

Thus, numerous characteristics and advantages of this invention have been set forth, together with details of structure and function. It is to be understood, however, that the disclosure is illustrative only. Therefore, any changes made, especially in matters of shape, size and arrangement, to the full extent extended by the general meaning of the terms in which the appended claims are expressed, are within the principle of this invention.

What is claimed is:

1. Fastening apparatus for shutters wherein a first edge of a first said shutter is separated from a second edge of an adjacent second said shutter to define a separation space, said first and second shutters being substantially in the same plane, said apparatus comprising:

a stud;

means for holding said stud, said holding means being attached to a framework behind the separation space between said first shutter and said second shutter;

a ramp member attached to said first shutter; and means, accessible through said separation space, for retractably advancing said stud generally parallel with said plane to contact said ramp member to draw said first shutter in a direction approximately perpendicular to said plane.

2. Apparatus in accordance with claim 1 wherein said stud includes a first portion having a generally circular cross sectional first shape, said first portion being at least partially threaded, said advancing means including a threaded nut on said first portion retained by said holding means, said nut being operable to advance said stud to apply a force against said ramp member.

3. Apparatus in accordance with claim 2 wherein said stud includes a second portion having a noncircular cross sectional second shape and said holding means includes aligned first and second circular and noncircular openings with similar but slightly larger cross sectional shapes than said first and second shapes, said holding means including a cavity between said first and second openings, said cavity being behind said separation space so that said nut is accessible through said separation space, whereby said stud is received by said first and second openings with said nut being retained on said stud within the cavity of said holding means.

4. Apparatus for fastening shutters to a wall wherein a first edge of a first of said shutters is separated from a second edge of an adjacent second of said shutters to define a separation space, said apparatus comprising:

a holding member for attachment to said wall;

a ramp member for attachment to one of said first and second shutters;

a elongated cam member movably attached to said holding member; and means, accessible through said separation space, for moving said cam member into contact with said ramp member so as to cam a portion of said one shutter toward said wall.

5. Apparatus in accordance with claim 4 wherein said cam member includes a stud having an end with an inclined surface which conforms to said ramp member as said moving means moves said stud against said ramp member.

6. In combination:

first and second shutters, for attachment to a wall, said first shutter having a first edge and said second shutter having a second edge, said first and second edges being separated to define a separation space; and means for attaching said first shutter at three locations to said wall, said attaching means at one of said three locations including a holding member and means for reversibly drawing said first shutter toward said wall, said drawing means being operable with a tool inserted through said separation space, said holding member including a cavity opening towards said shutters, said drawing means including a moveable member held by said holding member and means within said cavity for moving said moveable member, said moving means being operable with a tool extending through said separation space into said cavity, said drawing means also including means for receiving said moveable member, said holding means being attached to said wall and said receiving means being attached to said first shutter;

whereby the three attachment locations and said drawing means at least one of said three locations provides detachable attachment of said first shutter to said wall.

7. A combination in accordance with claim 6 wherein said attaching means includes a pair of hanger brackets attached to said walls and first and second clips attached to said first shutter, said clips having inverted cradle portions for being received by said hanger brackets, said attaching means further including a third clip attached to said shutter, said third clip including an inclined surface, said moveable member contacting said inclined surface and camming same, whereby said shutter pivots at one end about said hanger brackets to move toward said walls at an opposite end.

8. Apparatus for fastening a shutter to a structure, said shutter having a front and a back with the back facing said structure, said shutter having opposite top and bottom ends, said apparatus comprising:

a plurality of brackets attached to said structure;

means for resting on a pair of said brackets;

first means for attaching said resting means to said shutter near the bottom of said shutter;

a cam member with a threaded portion;

receiving means for being cammed by said cam member;

second means for attaching said receiving means near the top of said shutter; and a nut for threadingly fitting onto the threaded portion of said cam member;

a holder for said cam member, said holder retaining said nut with respect to said cam member, said holder being attached to said structure;

whereby said first shutter is adjustably held to said structure.

9. Apparatus in accordance with claim 8 wherein said first and second attaching means include inclined walls on said resting means and said receiving means and said shutter includes a plurality of inclined slots for receiving said walls, said first and second attaching means further including adhesive means for fastening said walls in said slots.

10. Apparatus in accordance with claim 8 wherein each of said brackets includes a horizontal member and said resting means includes at least one surface for fitting over a portion of said horizontal members so as to rest thereon.

11. Apparatus in accordance with claim 8 wherein said shutter includes a plurality of inclined slots and wherein said resting means and said receiving means each include a clip, said clip having an upright wall for placement against the back of said shutter, an upwardly inclined wall extending from one side of the upright wall, and a downwardly inclined wall extending from the other side of the upright wall, whereby one of said upwardly and downwardly inclined walls fits into one of said slots while the other of said upwardly and downwardly inclined walls either rests on one of said brackets or is cammed by said cam member.

* * * * *